US011149482B2

(12) United States Patent
Allen et al.

(10) Patent No.: US 11,149,482 B2
(45) Date of Patent: Oct. 19, 2021

(54) SLIDING PANEL LATCH SYSTEM AND ASSOCIATED METHODS

(71) Applicant: Ever Energy Inc, Springville, UT (US)

(72) Inventors: Paul J. Allen, Provo, UT (US); Derek John Shelley, Eagle Mountain, UT (US); Dennis LeGrand Olsen, Eagle Mountain, UT (US); Kurt Seeley Olsen, Kaysville, UT (US)

(73) Assignee: Ever Energy Inc., Springville, UT (US)

( * ) Notice: Subject to any disclaimer, the term of this patent is extended or adjusted under 35 U.S.C. 154(b) by 803 days.

(21) Appl. No.: 15/281,630

(22) Filed: Sep. 30, 2016

(65) Prior Publication Data

US 2018/0094464 A1 Apr. 5, 2018

(51) Int. Cl.

| | |
|---|---|
| ***E05D 15/06*** | (2006.01) |
| ***E05B 65/08*** | (2006.01) |
| ***E05B 53/00*** | (2006.01) |
| *E05B 17/20* | (2006.01) |

(52) U.S. Cl.

CPC ..... *E05D 15/0652* (2013.01); *E05B 53/00* (2013.01); *E05B 65/0811* (2013.01); *E05B 17/2038* (2013.01); *E05D 15/0626* (2013.01)

(58) Field of Classification Search

CPC ..... Y10S 292/46; Y10S 292/62; Y10S 70/42; E05B 65/0811; E05B 65/0817; E05B 65/08; E05B 47/0607; E05C 3/041; E05C 9/026

See application file for complete search history.

(56) References Cited

U.S. PATENT DOCUMENTS 1,686,417 A * 10/1928 Norman ..... E05B 65/0811 292/108
2,666,319 A * 1/1954 Price ..... E05B 65/0811 70/97
2,668,071 A * 2/1954 Adams ..... E05B 65/0811 292/129
2,712,464 A * 7/1955 Collar ..... E05B 65/0811 292/128
2,789,852 A * 4/1957 Eads ..... E05B 65/0817 292/110
2,810,284 A * 10/1957 Wartian ..... E05B 65/0811 70/99
3,019,043 A * 1/1962 Woodworth ..... E05B 65/0817 292/113
3,025,693 A * 3/1962 Braginetz ..... E05B 65/0811 70/100
3,040,555 A * 6/1962 Wartian ..... E05C 3/24 70/97

(Continued)

*Primary Examiner* — Mark A Williams
(74) *Attorney, Agent, or Firm* — Thorpe North & Western, LLP

(57) ABSTRACT

The present disclosure is drawn to a sliding panel latch system and related methods. The sliding panel latch system can comprise a striker, a sliding panel movable relative to the striker, and a latch rotatably coupled to the panel. The latch can have a striker interface to engage the striker. The striker interface can at least partially define a striker opening to receive the striker. The latch can be rotatable to a latch position to secure the striker in the striker opening and to a receive/release position to receive the striker in the striker opening or release the striker from the striker opening.

25 Claims, 10 Drawing Sheets

(56) References Cited

U.S. PATENT DOCUMENTS

| | | | | | |
|---|---|---|---|---|---|
| 3,041,097 | A * | 6/1962 | Eads | E05B 65/0817 | 292/113 |
| 4,030,246 | A | 6/1977 | Naylor | | |
| 4,643,005 | A * | 2/1987 | Logas | E05C 9/026 | 292/20 |
| 5,098,139 | A * | 3/1992 | Larsson | E05B 65/0811 | 292/337 |
| 5,174,617 | A * | 12/1992 | Huber | E05B 17/2038 | 292/106 |
| 5,653,483 | A * | 8/1997 | Grover | E05B 63/0052 | 292/194 |
| 5,722,704 | A * | 3/1998 | Chaput | E05B 65/0811 | 292/26 |
| 6,327,879 | B1 * | 12/2001 | Malsom | E05B 65/0811 | 292/197 |
| 8,096,593 | B2 | 1/2012 | Gibbons | | |
| 9,091,106 | B2 | 7/2015 | Allen et al. | | |
| 2004/0068835 | A1 | 4/2004 | Satterfield | | |
| 2006/0119108 | A1 * | 6/2006 | Heid | E05B 15/0006 | 292/97 |
| 2013/0106119 | A1 * | 5/2013 | Stendal | E05B 15/101 | 292/113 |
| 2014/0319851 | A1 * | 10/2014 | Curtis | E05B 65/0021 | 292/215 |

* cited by examiner

SLIDING PANEL LATCH SYSTEM AND ASSOCIATED METHODS

BACKGROUND

Panels, such as doors, windows, signage, shutters, chalkboards, partitions, etc., are available in a wide variety of configurations and are often movable (i.e., slidable). In particular, one type of door, known as a "barn door," is typically slidable along a track or rail to block or allow access through a doorway. Some slidable panels include features that enable the panels to be latched or locked in a given position, such as latching a door in a closed position, to prevent unwanted movement of the panel from the position.

DETAILED DESCRIPTION

Reference will now be made to the exemplary embodiments, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. It is also to be understood that the terminology used herein is used for the purpose of describing particular embodiments only. The terms are not intended to be limiting unless specified as such.

The present disclosure is drawn to a sliding panel latch system that can be utilized by a variety of different panel types, such as doors, windows, signage, shutters, chalkboards, partitions, etc. in which releasable latching of panels is desired. The sliding panel latch system can enable latching of a panel in a predetermined position (e.g., a closed or open position). In one aspect, the sliding panel latch system can enable locking the panel once the panel has been latched. The sliding panel latch system can comprise a striker, a sliding panel movable relative to the striker, and a latch rotatably coupled to the panel. The latch can have a striker interface to engage the striker. The striker interface can at least partially define a striker opening to receive the striker. The latch can be rotatable to a latch position to secure the striker in the striker opening and to a receive/release position to receive the striker in the striker opening or release the striker from the striker opening.

In one aspect, the disclosure provides a method for releasably latching a sliding panel. The method can comprise providing a striker at a structure such that a sliding panel is movable relative to the striker. For example, this step can include coupling the striker to the structure. The method can also comprise rotatably coupling a latch to the sliding panel, the latch having a striker interface to engage the striker, the striker interface at least partially defining a striker opening to receive the striker, wherein the latch is rotatable to a latch position to secure the striker in the striker opening and to a receive/release position to receive the striker in the striker opening or release the striker from the striker opening. The method can further comprise moving the sliding panel toward the striker with the latch in the receive/release position until the striker engages the striker interface of the latch causing the latch to move to the latch position where the striker is secured in the striker opening of the latch. Additionally, the method can comprise causing the latch to move to the receive/release position facilitating release of the striker from the striker opening of the latch.

Figure 1:
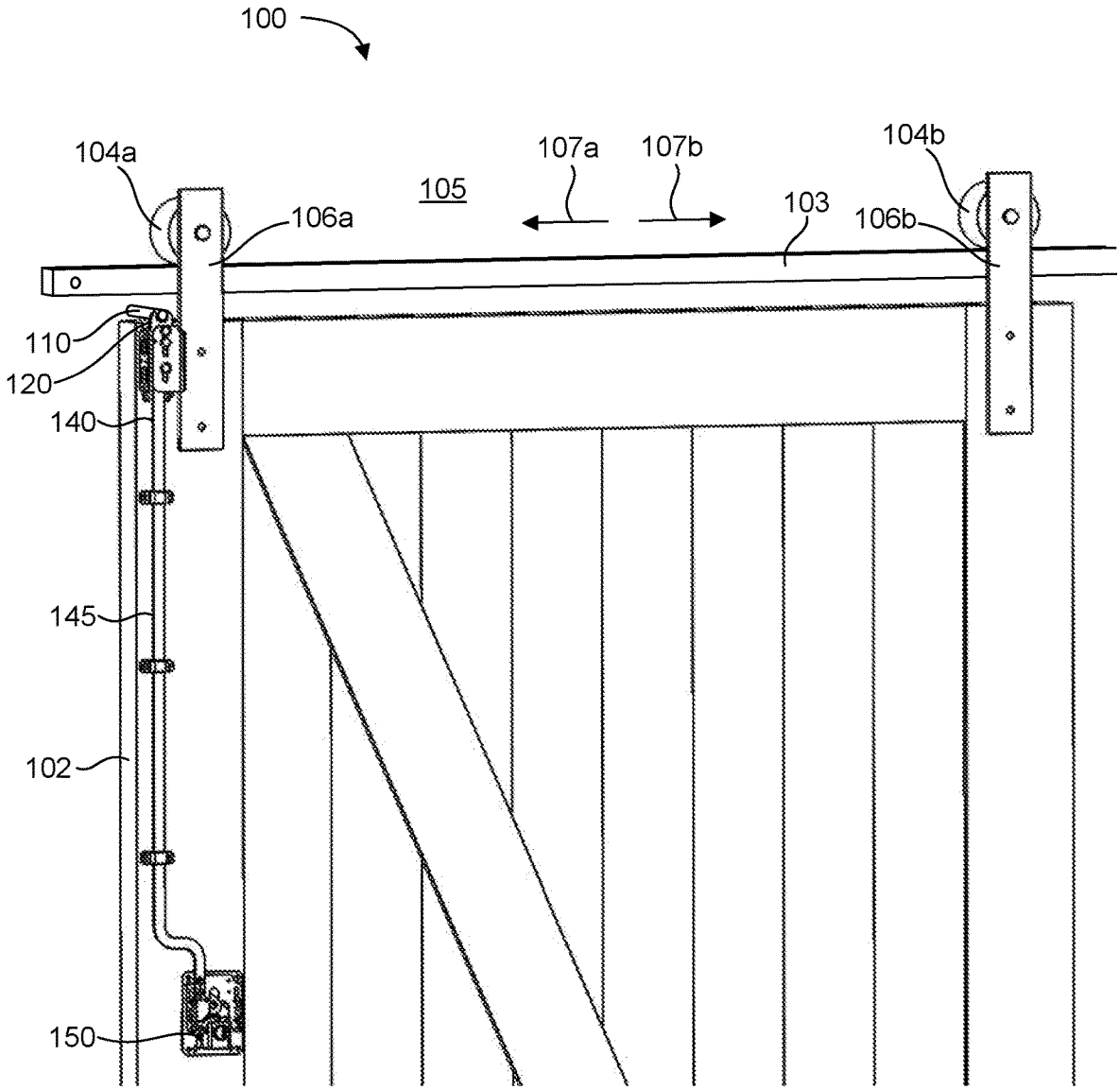
FIG. 1 is a perspective view of a sliding panel latch system, in accordance with an example of the present disclosure.

FIG. 1 shows an example of a sliding panel latch system 100 in accordance with the present disclosure. The system can include a sliding panel. As used herein, a "panel" can include a door, a window, a gate, a sign, a shutter, a chalkboard, a partition, or any other type of panel. In some embodiments illustrated and discussed herein, a panel 102 is depicted as a door. Although a door may be illustrated and referred to generally herein, it should be recognized that the descriptions and embodiments of the present disclosure can be applied to any panel system. A panel can be "sliding" in a broad sense of the term consistent with typical usage when referring to sliding panels, such as sliding doors, sliding windows, sliding gates, etc. For example, a panel can be referred to as "sliding" by being movable along a surface while being in continuous contact with the surface. Sliding panels can be configured to slide in any suitable manner. For example, sliding may be aided by placing relatively low friction surfaces in direct contact and/or by utilizing wheels, such as bearings or rollers.

One example of sliding panel structures is shown in FIG. 1, which utilizes a track 103 and wheels 104*a*, 104*b* configured to interface with the track, which facilitates sliding movement of the panel 102 along the track. As shown in the figure, the track 103 is coupleable to a support structure 105, such as a wall. As used herein, a "support structure" can include a wall, a ceiling, a floor, or any other suitable support structure for a panel, a door, a window, a gate, a sign, a shutter, a chalkboard, a partition, etc. The track 103 can be oriented substantially horizontal and can provide a support structure for the panel 102. The sliding panel can also include hangers 106*a*, 106*b* to couple with the panel 102 and to interface with the track 103. Thus, the hangers can be coupled to wheels 104*a*, 104*b* that can be configured to interface with and roll along the track. The panel 102 can therefore be supported by the track 103 and bi-directionally movable in directions 107*a*, 107*b* along the track 103. Although the track 110 is shown coupled to the support structure 105, it should be recognized that one or more wheels can be coupled to a support structure, such as via adjustable spacers, and a track can be coupled to a hanger. In this case, for example, a series of wheels can be aligned along the support structure and the track can be coupled to a panel or door and can move with the panel relative to the support structure by riding on the wheels.

Figure 2B:
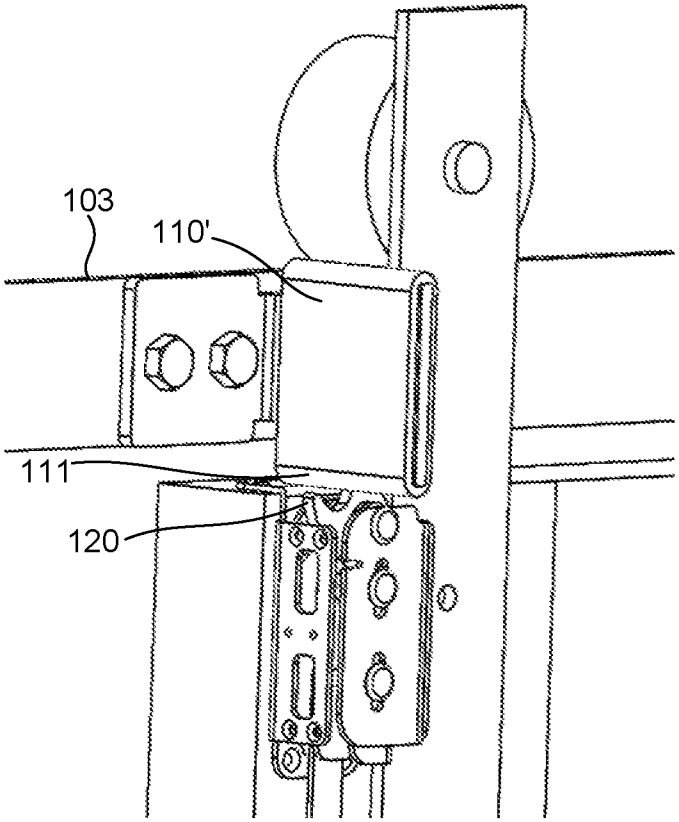
FIG. 2B is a detail perspective view of the sliding panel latch system of FIG. 1, with the latch in a receive/release position, in accordance with an example of the present disclosure.
Figure 2A:
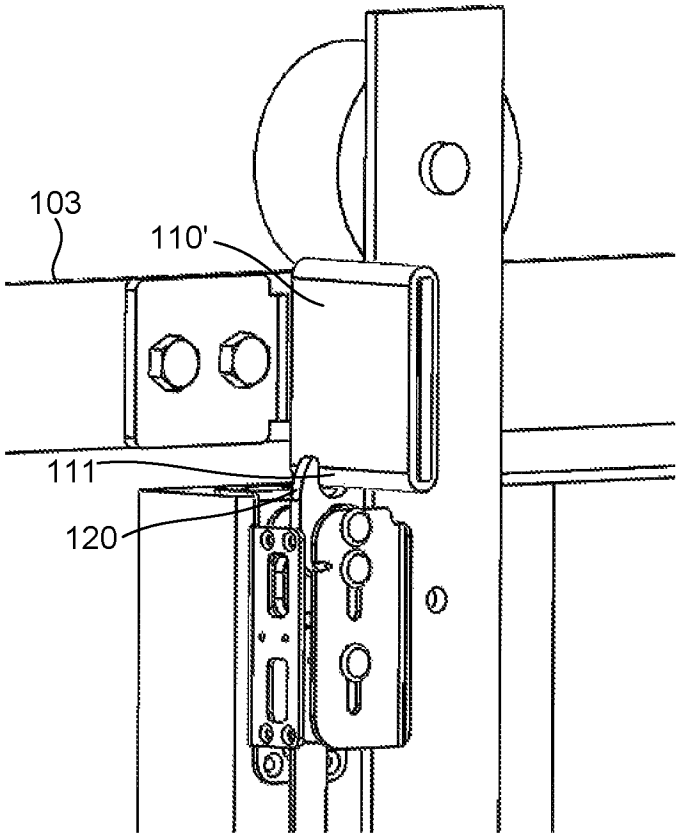
FIG. 2A is a detail perspective view of the sliding panel latch system of FIG. 1, with a latch in a latch position, in accordance with an example of the present disclosure.

The sliding panel latch system 100 can also include a striker 110. The panel 102 can be movable relative to the striker 110, such as in directions 107*a*, 107*b* along the track 103. For example, the striker 110 can be fixedly coupled to the support structure 105 (e.g., a wall), as shown in FIG. 1, or optionally to the track 103. In addition, the sliding panel latch system 100 can include a latch 120 rotatably coupled to the panel 102. The latch 120 is rotatable to a latch position (shown in FIG. 1) to secure the striker 110. The latch 120 is also rotatable to a receive/release position to receive the striker 110 or release the striker 110. FIGS. 2A and 2B show detail views of the system 100, with the latch 120 in the latch position (FIG. 2A) and the receive/release position (FIG. 2B). In this case, alternative striker 110' is shown fixedly coupled to the track 103.

Figure 3:
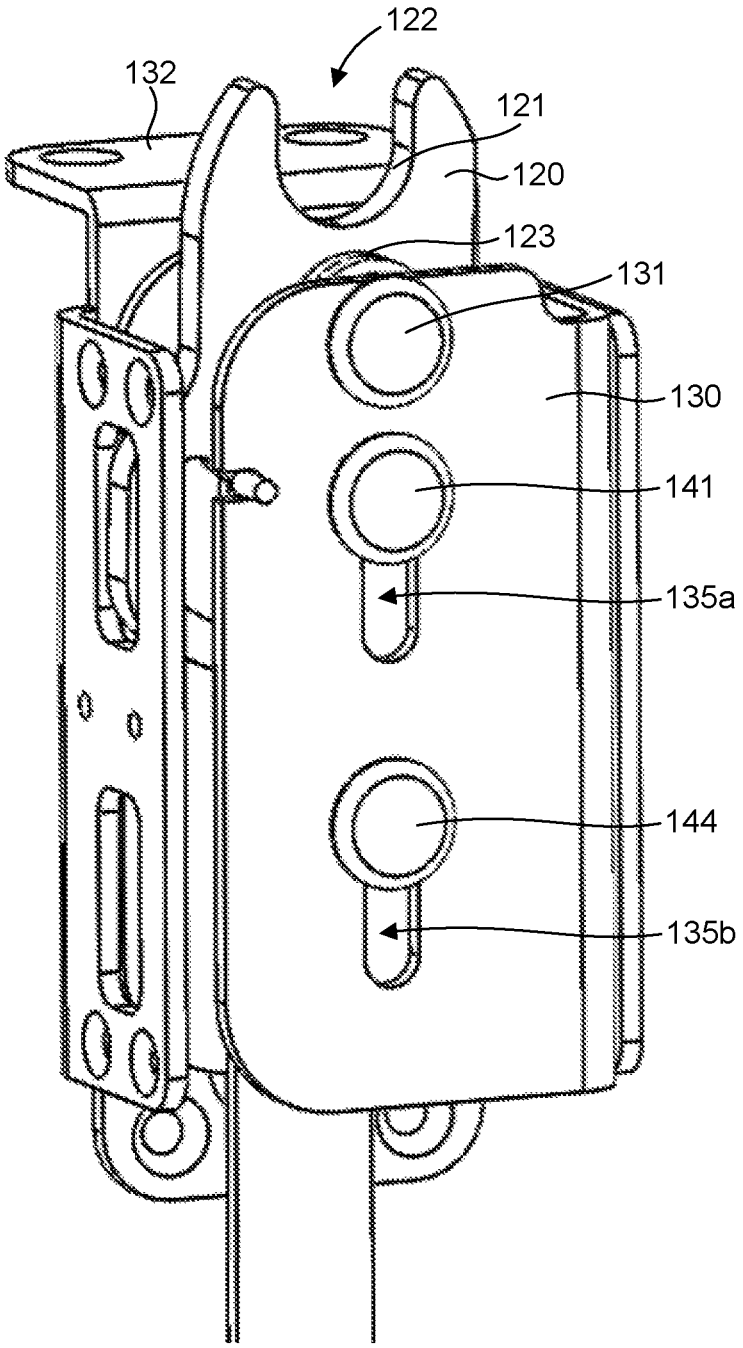
FIGS. 3-5 are detailed perspective views of the latch of the sliding panel latch system of FIG. 1.
Figure 4:
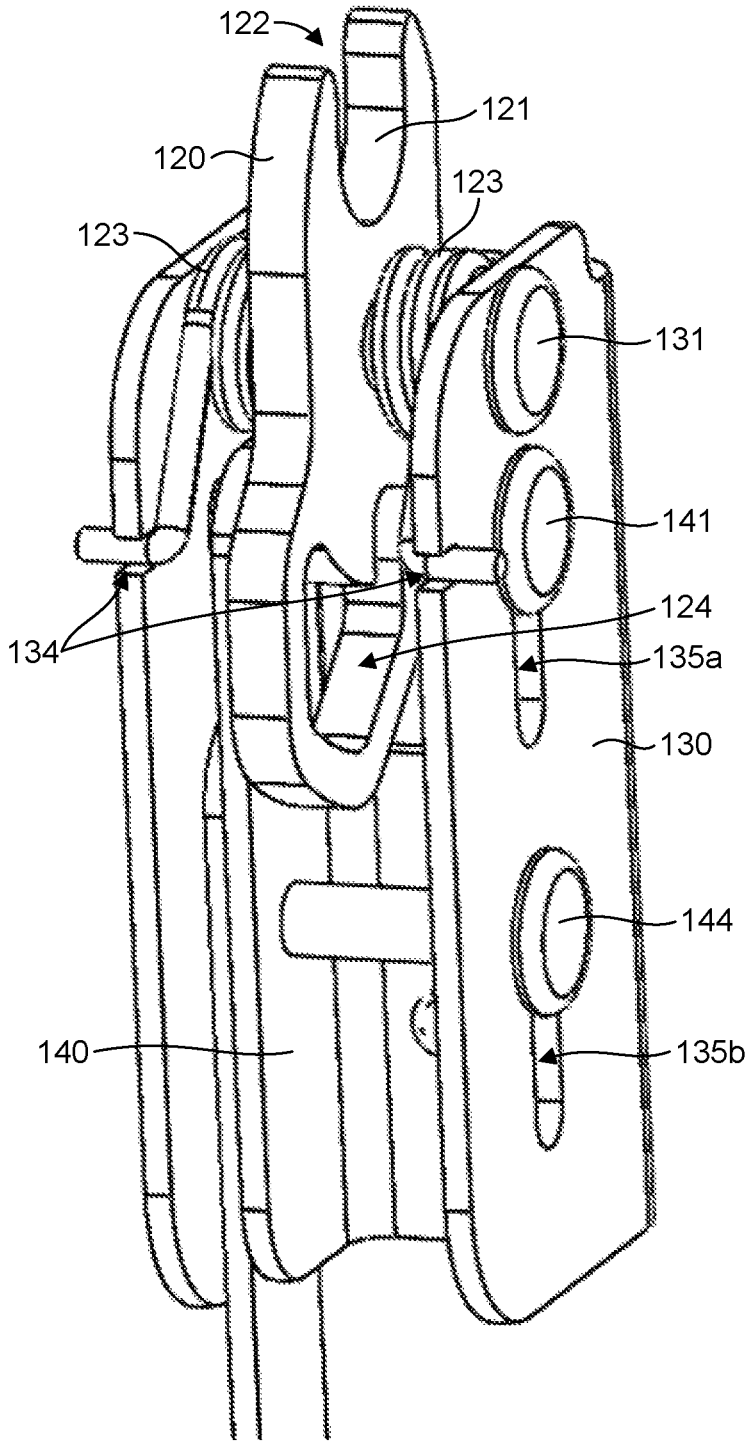
Figure 5:
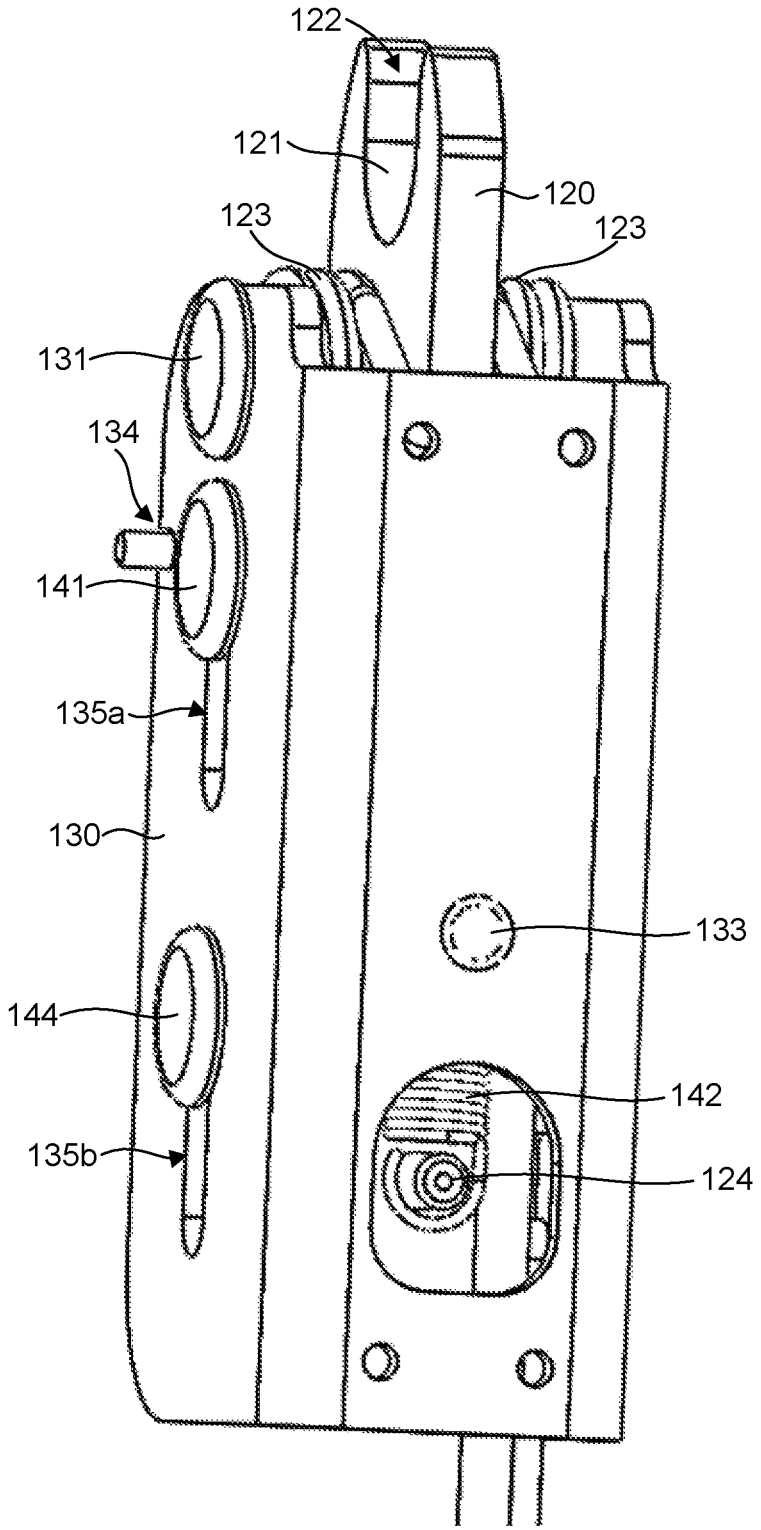

With continued reference to FIGS. 1-2B as well as FIGS. 3-5, the latter illustrates various perspective view details of the latch 120 and associated structures. For example, the latch 120 can have a striker interface 121 to engage the striker (i.e., the striker 110 or the striker 110'). The striker interface 121 can at least partially define a striker opening 122 to receive the striker. Thus, the latch 120 is rotatable to the latch position (FIG. 2A) to secure the striker in the striker opening 122 and rotatable to the receive/release position (FIG. 2B) to receive the striker in the striker opening or release the striker from the striker opening. Typically, when moving the panel 102 toward the striker, the striker can engage or contact the striker interface 121 causing the latch to move from the receive/release position to the latch position. In one aspect, the striker can include a curved latch interface surface (e.g., latch interface 111 of the striker 110' in FIGS. 2A and 2B) to engage the striker interface 121 of the latch. Similarly, the striker interface 121 can have a curved surface to engage the curved latch interface surface. Such interfacing curved surfaces can have any suitable configuration. In some embodiments, the curved surfaces of the latch interface and the striker interface are rounded or defined at least in part by a circle (e.g., a portion of a cylinder). Curved interfacing surfaces can facilitate smooth operation of the system 100, which can accommodate linear movement of the panel 102 along a straight track 103 when the latch 120 receives and releases the striker. Although the latch is shown in FIGS. 3-5 in the latch position, the latch 120 can be biased to the receive/release position by a spring 123.

The sliding panel latch system 100 can also include a latch body 130 in support of the latch 120. The latch can be rotatably coupled to the latch body, such as by a pivot pin 131. The latch body 130 can be coupled to the panel 102 in any suitable manner. For example, the latch body 130 can be coupled to the panel by a mounting bracket 132, which is shown in FIG. 3 and omitted from FIGS. 4 and 5.

Figure 6:
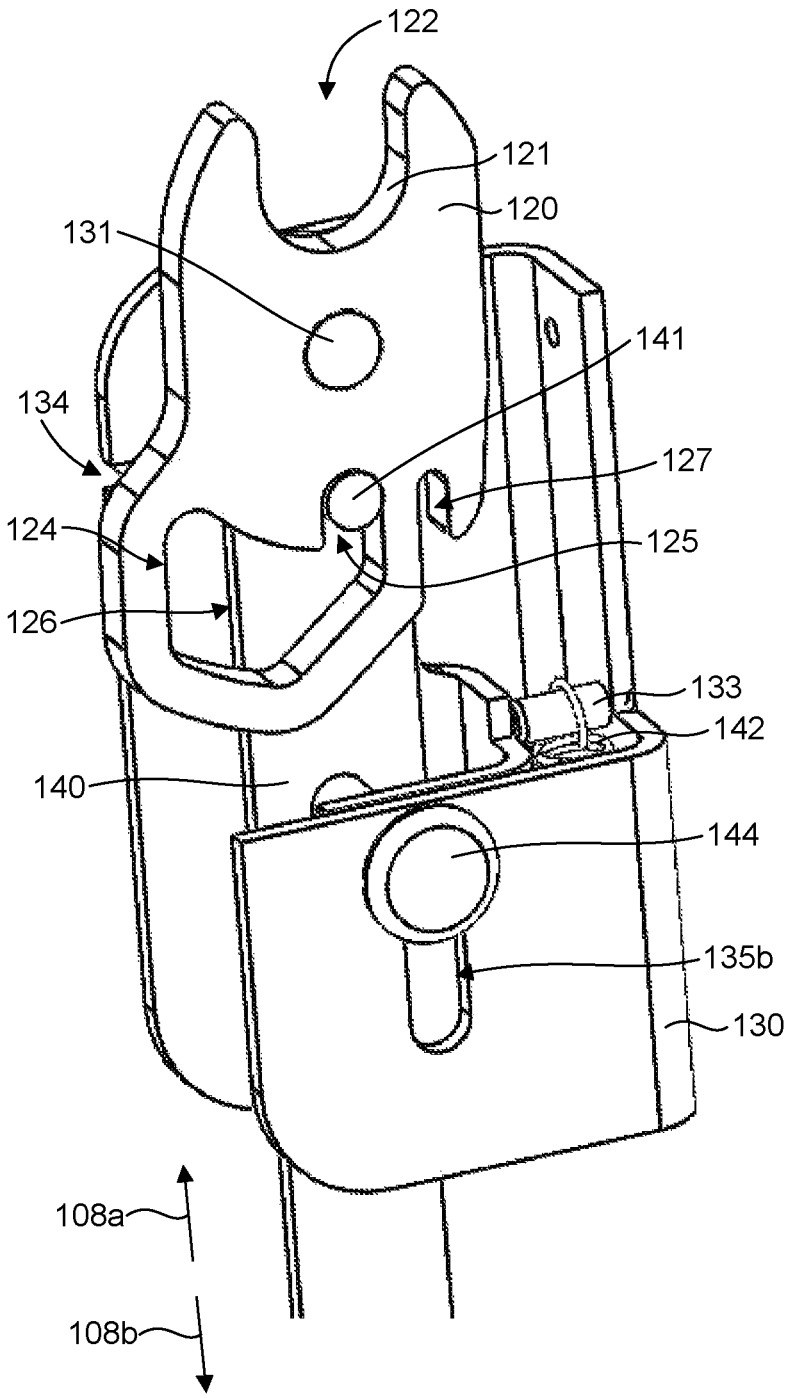
FIG. 6 is a detail cutaway perspective view of the latch of the sliding panel latch system of FIG. 1, with the latch in a latch position.
Figure 7:
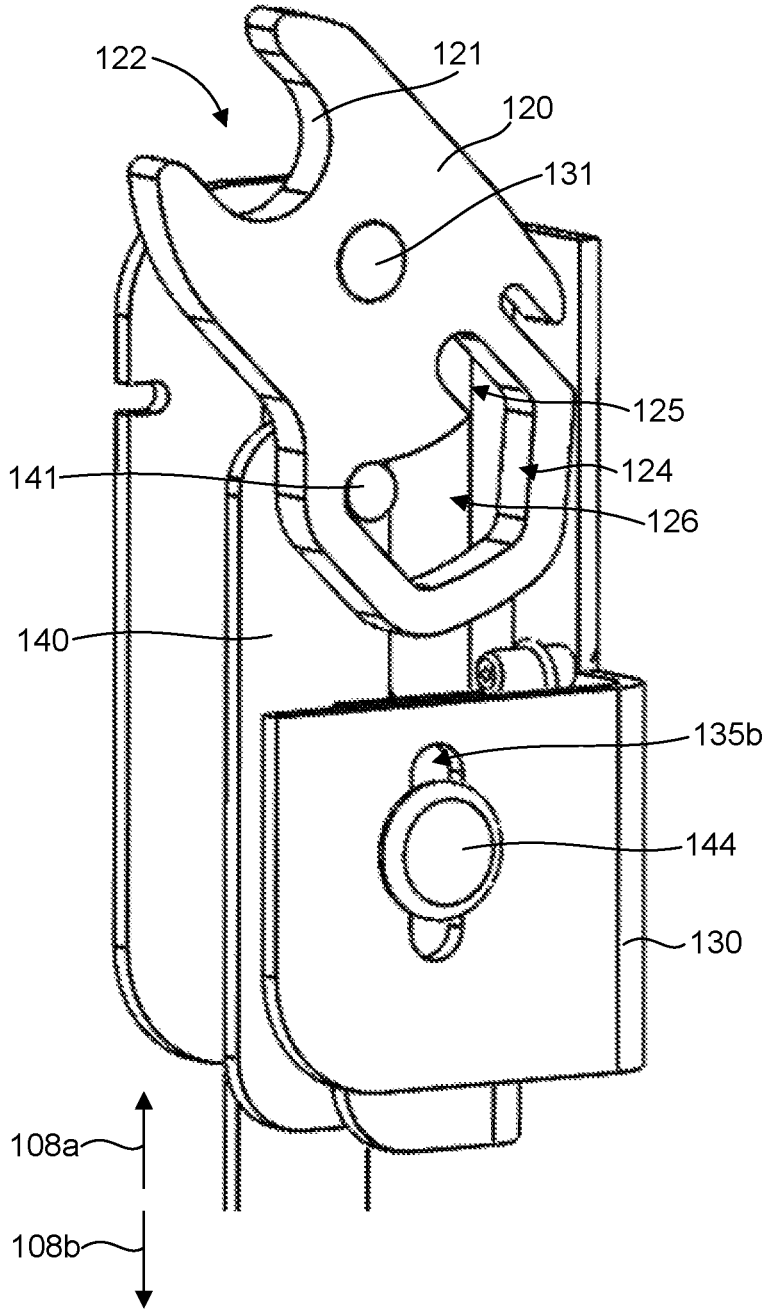
FIG. 7 is a detail cutaway perspective view of the latch of the sliding panel latch system of FIG. 1, with the latch in a receive/release position.

With continued reference to FIGS. 1-5, and further with respect to FIGS. 6 and 7, the latch body 130 is cutaway to reveal additional features of the latch 120. In these FIGS., the spring 123 has also been omitted. FIG. 6 shows the latch 120 in the latch position and FIG. 7 shows the latch 120 in the receive/release position. The sliding panel latch system 100 can include a latch lock 140 to maintain the latch 120 in the latch position. The latch lock 140 is movable to a latch lock position (FIG. 6) such that the latch 120 is maintained in the latch position. In other words, movement of the panel 102 tending to cause the latch 120 to move toward the receive/release position can be resisted by latch lock 140, which can mechanically interfere with movement of the latch 120 from the latch position. The latch lock 140 can be movable to a latch release position (FIG. 7) such that the latch 120 is free to move between the latch and receive/release positions. The latch lock 140 can be bi-directionally movable (e.g., in directions 108*a*, 108*b*) in a translational degree of freedom to the latch lock and latch release positions.

The latch 120 can include a latch lock opening 124 that defines the latch position and the receive/release position. The latch lock 140 can have a latch protrusion 141 (e.g., a pin) disposed in the latch lock opening 124. The position of the latch protrusion 141 relative to the latch lock opening 124 can establish a position of the latch 120 in the latch position or the receive/release position. For example, the latch lock opening 124 can include a detent 125, which is operable with the latch lock 140 to position and maintain the latch 120 in the latch position. Thus, when the latch 120 is moved to the latch position and the latch lock 140 is moved in direction 108*a* to cause the latch protrusion 141 to be located in the detent 125, the latch 120 can be positioned in the latch position, as shown in FIG. 6. The latch lock 140 can maintain the latch 120 in the latch position until the latch lock is moved in direction 108*b* to cause the latch protrusion 141 to vacate the detent 125 and move into a release region 126 of the latch lock opening 124. In this relationship, the latch 120 is free to move, such as to the receive/release position, as shown in FIG. 7.

The latch protrusion 141 and a pin 144 can be received in guide slots 135*a*, 135*b* in the latch body 130 to constrain the latch lock 140 to bi-directional movement in a translational degree of freedom. The latch lock 140 can be biased to the latch lock position (e.g., in direction 108*a*) by a spring 142. In this case, the spring 142 is placed in tension and connected to the latch lock 140 by a pin 143 and to the latch body 130 by a pin 133. In addition, the spring 123 that biases the latch 120 to the receive/release position can be coupled to the latch 120 by a recess 127 and to the latch body 130 by a recess 134.

Figure 8B:
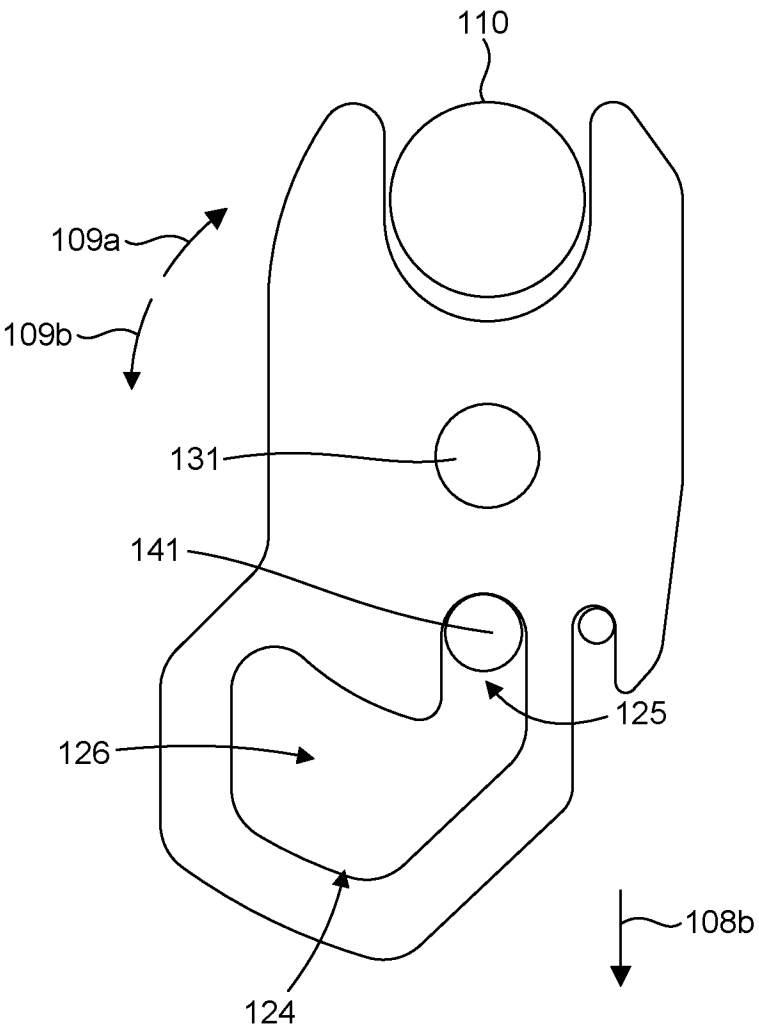
FIG. 8B is a schematic representation illustrating operation of the latch of the sliding panel latch system of FIG. 1 with the latch in a latch position, in accordance with an example of the present disclosure.
Figure 8A:
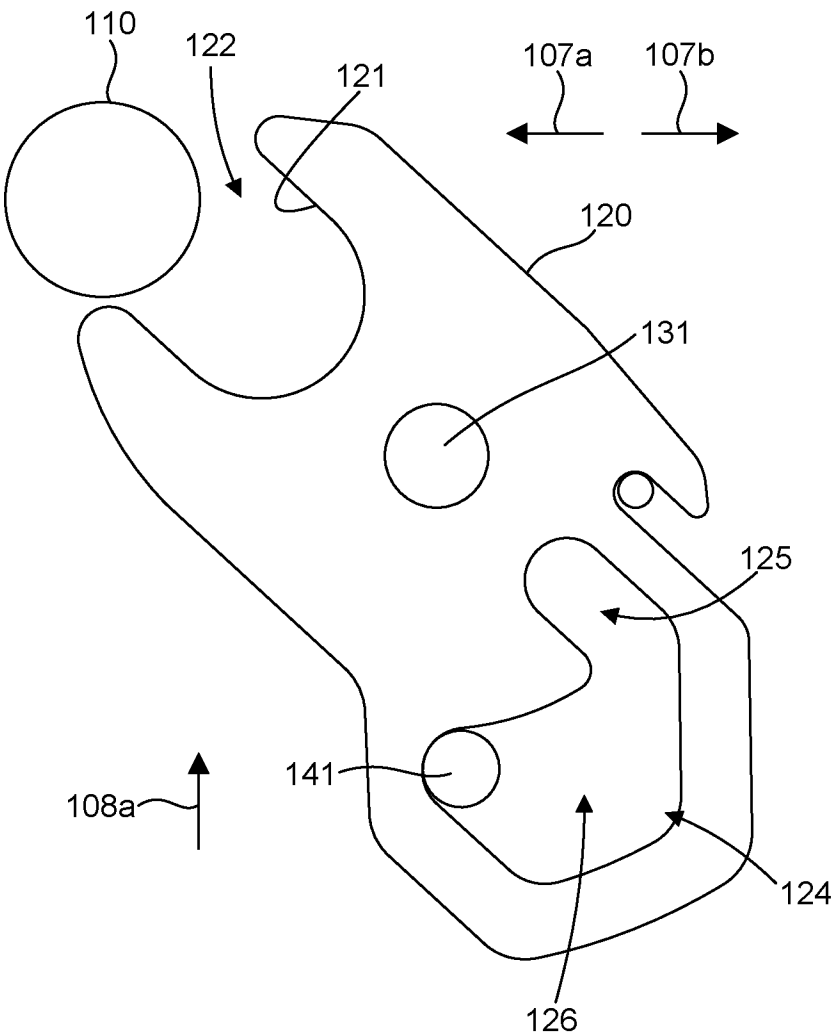
FIG. 8A is a schematic representation illustrating operation of the latch of the sliding panel latch system of FIG. 1 with the latch in a receive/release position, in accordance with an example of the present disclosure.

In operation, the latch 120 can move toward the striker 110 in direction 107*a* while biased toward the receive/release position, as schematically illustrated in FIG. 8A. With the latch 120 in the receive/release position, the latch lock (shown as the latch protrusion 141) can be located in the release region 126 of the latch lock opening 124. The latch protrusion 141 can be biased in direction 108*a* into contact with the latch 120. When the striker 110 engages the striker interface 121 of the latch 120, the striker can cause the latch to rotate in direction 109*a* about the pivot pin 131 to the latch position, as illustrated in FIG. 8B, where the striker is captured in the striker opening 122. As the latch rotates in direction 109*a*, the latch protrusion 141 can slide along the latch 120 until the latch position is achieved, at which point the biased latch protrusion 141 moves in direction 108*a* into the detent 125 of the latch lock opening 124, thus locking the latch in the latch position, and thereby securing the panel 102 in a desired location. To release the striker 110 so that the panel 102 can be moved, the latch protrusion 141 can be moved in direction 108*b* out of the detent 125 into the release region 126 of the latch lock opening 124. With the latch protrusion 141 in the release region 126, the bias applied to the latch 120 can cause the latch to rotate in direction 109*b* toward the receive/release position where the striker 110 can be released from the striker opening 122.

As illustrated in FIG. 1, the sliding panel latch system 100 can include a panel lock 150 to prevent the latch lock 140 from moving out of the latch lock position, thereby locking the panel 102 in a desired location as established by the location of the striker 110. Because the striker 110 may be located at a top of the panel 102, the latch lock 140 can include an extension portion 145 to couple with the panel lock 150, which may be located within convenient reach of a user.

With continued reference to FIGS. 1-8B, FIGS. 9 and 10 further illustrate detail views of the panel lock 150 and associated features. The panel lock 150 is movable to a panel lock position such that the latch lock 140 is prevented from moving out of the latch lock position described above. In addition, the panel lock 150 is movable to a panel unlock position (shown in FIG. 9) such that the latch lock 140 is free to move to the latch lock and the latch release positions described above. The latch lock 140 can include a slidable plate 146, which can be coupled to the extension portion 145, such as by fasteners 160. The slidable plate 146 is constrained to movement in a translational degree of freedom (e.g., linear movement in directions 108*a*, 108*b*) by guide posts 161*a-d* extending through guide slots 147*a-d*, respectively, in the plate 146. The plate 146 can be caused to move in direction 108*b* by rotation of a latch lock user interface 170, which can facilitate movement of the latch lock 140 from the latch lock position to the latch release position by a user. The latch lock user interface 170 can be coupled to a lever arm 171, which is coupled to a pin 172 that is received in a slot 148 of the plate 146. The slot 148 can be configured to accommodate relative movement of the pin 172 as rotation of the latch lock user interface 170 causes the pin 172 to act on the plate 146, which causes the plate 146 to move in direction 108*b* to release the latch 120. The plate 146 can be biased in direction 108*a* by springs 162*a*, 162*b*, which can be placed in tension between the guide post 161*a* and an anchor post 163*a* coupled to the plate 146, and the guide post 161*c* and an anchor post 163*b* coupled to the plate 146.

To prevent unwanted release of the latch 120, the panel lock can include a lock protrusion 151 (extending into the arced opening 152) that mechanically interferes with movement of the latch lock 140 when in the panel lock position. For example, in the panel lock position, the lock protrusion 151 of the panel lock 150 can be configured to interface with the plate 146 at 153 to mechanically interfere with movement of the latch lock 140 in direction 108*b*, which would release the latch 120. The panel lock 150 can be bi-directionally movable in a rotational degree of freedom to the panel lock position (e.g., in direction 154*a*) and to the panel unlock position (e.g., in direction 154*b*). Such movement can be accomplished by including a panel lock user interface 155*a*, 155*b*, which can facilitate movement of the panel lock 150 to the panel lock position and to the panel unlock position by a user.

The latch lock user interface 170 and the panel lock user interface 155*a* can have any suitable configuration, such as a lever, a handle, a knob, etc. In one aspect, the panel lock user interface 155*b* can include security features, such as tumblers, and therefore may be movable with a key. The latch lock user interface 170 can be located in a recess opening 173 in order to be recessed within the panel 102 and avoid or minimize the latch lock user interface 170 protruding from the panel. With the latch lock user interface 170 recessed in the recess opening 173, the panel 102 can maintain its profile, which may aid in movement of the panel in a tight space without interference from the latch lock user interface 170.

Figure 9:
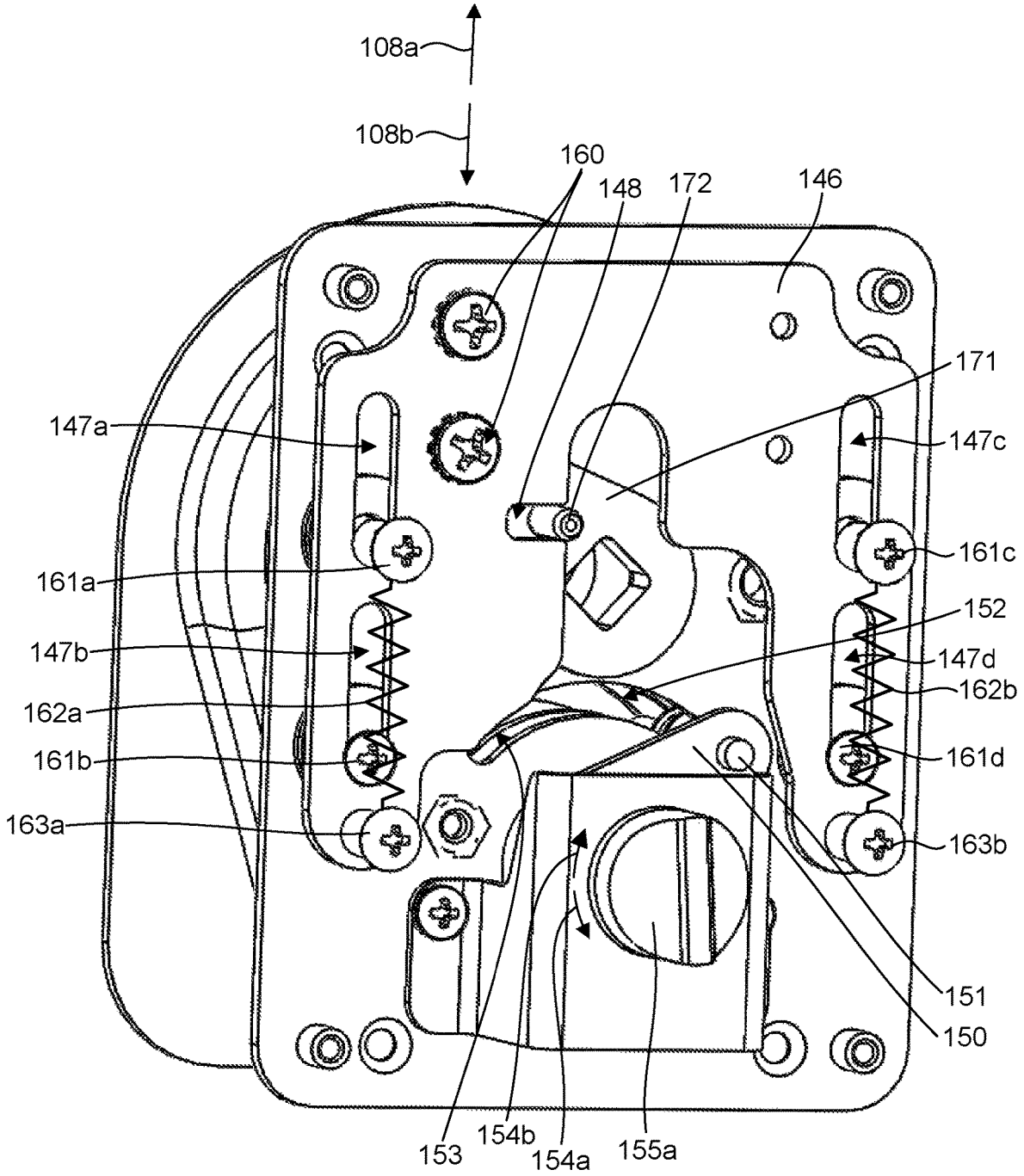
FIG. 9 is a detail perspective view of side of a panel lock of the sliding panel latch system of FIG. 1, in accordance with an example of the present disclosure.
Figure 10:
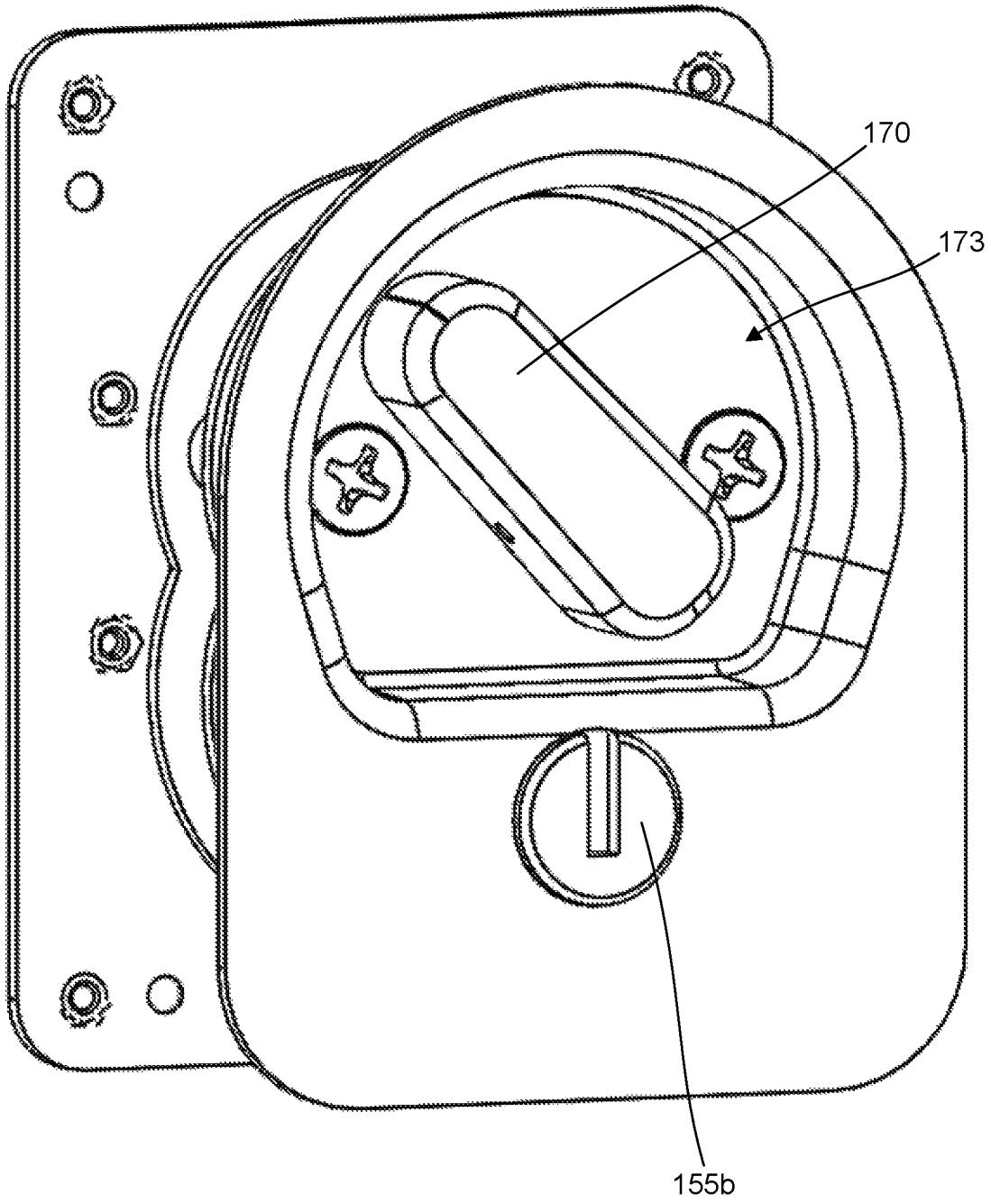
FIG. 10 is a detail perspective view of an opposite side of the panel lock of the sliding panel latch system of FIG. 1, in accordance with an example of the present disclosure.

Notably, with respect to FIG. 9 in particular, latching and locking movement shown in herein can be modified in any manner, as there are any of a number of mechanical mechanisms for carrying out this function. The example shown in FIG. 9 is one possible example of a latch lock mechanism. The same is true of other mechanisms described throughout, including the shape and configuration of the panel lock, the extension portion, of the latch, etc.

In accordance with one embodiment of the present invention, a method for releasably latching a sliding panel is also disclosed. The method can comprise coupling a striker to a structure such that a sliding panel is movable relative to the striker. The method can also comprise rotatably coupling a latch to the sliding panel, the latch having a striker interface to engage the striker, the striker interface at least partially defining a striker opening to receive the striker, wherein the latch is rotatable to a latch position to secure the striker in the striker opening and to a receive/release position to receive the striker in the striker opening or release the striker from the striker opening. The method can further comprise moving the sliding panel toward the striker with the latch in the receive/release position until the striker engages the striker interface of the latch causing the latch to move to the latch position where the striker is secured in the striker opening of the latch. Additionally, the method can comprise causing the latch to move to the receive/release position facilitating release of the striker from the striker opening of the latch. It is noted that no specific order is required in this method, though generally in one embodiment, these method steps can be carried out sequentially.

In one aspect of the method, the sliding panel is movable along a track. In one aspect of the method, the track is straight such that the sliding panel is movable linearly along the track when the latch receives and releases the striker. In one aspect of the method, coupling the striker to the structure comprises coupling the striker to the track. In one aspect of the method, coupling the striker to the structure such that the sliding panel is movable relative to the striker comprises coupling the track and the striker to a support structure. In one aspect of the method, the support structure comprises a wall. In one aspect of the method, the panel is a door. In one aspect of the method, rotatably coupling the latch to the panel comprises coupling a latch body to the panel, wherein the latch is supported by, and rotatably coupled to, the latch body. In one aspect of the method, the striker includes a curved latch interface surface to engage the striker interface of the latch. In one aspect of the method, the striker interface comprises a curved surface to engage the curved latch interface surface. In one aspect of the method, the latch is biased to the receive/release position. In one aspect, the method further comprises coupling a latch lock to the panel to maintain the latch in the latch position. In one aspect of the method, the latch lock is movable to a latch lock position such that the latch is maintained in the latch position, and to a latch release position such that the latch is free to move between the latch and receive/release positions. In one aspect of the method, the latch lock is biased to the latch lock position. In one aspect of the method, the latch lock is bi-directionally movable in a translational degree of freedom. In one aspect of the method, the latch comprises a latch lock opening that defines the latch position and the receive/release position, and the latch lock comprises a latch protrusion disposed in the latch lock opening, and wherein the position of the latch protrusion relative to the latch lock opening establishes a position of the latch in the latch position or the receive/release position. In one aspect, the method further comprises coupling a latch lock user interface to the panel to facilitate movement of the latch lock from the latch lock position to the latch release position by a user. In one aspect of the method, the latch lock user interface is recessed within the panel. In one aspect, the method further comprises coupling a panel lock to the panel to prevent the latch lock from moving out of the latch lock position. In one aspect of the method, the panel lock is movable to a panel lock position such that the latch lock is prevented from moving out of the latch lock position and a panel unlock position such that the latch lock is free to move between the latch lock and latch release positions. In one aspect of the method, the latch lock comprises an extension portion to couple with the panel lock. In one aspect of the method, the panel lock comprises a lock protrusion that mechanically interferes with movement of the latch lock when in the panel lock position. In one aspect of the method, the latch lock comprises a slidable plate, and the lock protrusion of the panel lock is configured to interface with the plate to mechanically interfere with movement of the latch lock when in the panel lock position. In one aspect of the method, the panel lock is bi-directionally movable in a rotational degree of freedom to the panel lock position and the panel unlock position. In one aspect, the method further comprises coupling a panel lock user interface to the panel to facilitate movement of the panel lock to the panel lock position and to the panel unlock position by a user. In one aspect of the method, the panel lock user interface is movable with a key.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

It is noted that, as used in this specification and the appended claims, the singular forms "a," "an," and "the" include plural referents unless the content clearly dictates otherwise.

In describing embodiments of the present invention, reference will be made to "first" or "second" as they relate to spacer threaded portions, for example. It is noted that these are merely relative terms, and a spacer threaded portion described or shown as a "first" threaded portion could just as easily be referred to a "second" threaded portion, and such description is implicitly included herein.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A sliding panel latch system, comprising:

a striker;

a sliding panel bidirectionally movable along a track relative to the striker in a direction of the track; and a latch rotatably coupled to the panel, the latch having a striker interface to engage the striker, the striker interface at least partially defining a striker opening to receive the striker, wherein the latch is rotatable to a latch position to secure the striker in the striker opening and to a receive/release position to receive the striker in the striker opening or release the striker from the striker opening, wherein with the latch in the receive/release position, engagement and relative movement between the striker and the striker interface of the latch is operable to cause the latch to move to the latch position, and wherein, in the latch position, engagement of the striker interface with the striker is operable to secure the striker in the striker opening against bidirectional movement of the panel in the direction of the track; and wherein the latch comprises a latch lock opening with a detent and a release region, the latch lock opening comprises a latch protrusion disposed in the latch lock opening, and the detent is operable to receive and maintain the latch protrusion when the latch is moved to the latch position, and the release region is operable to receive the latch protrusion when the latch is moved to the receive/release position.

2. The sliding panel latch system of claim 1, wherein the system further comprises the track, and wherein the sliding panel is movable along the track via hangers.

3. The sliding panel latch system of claim 2, wherein the track is straight such that the sliding panel is movable linearly along the track when the latch receives and releases the striker.

4. The sliding panel latch system of claim 2, wherein the striker is coupled to the track.

5. The sliding panel latch system of claim 2, wherein the track is coupled to a support structure, and the striker is coupled to either the track or the support structure.

6. The sliding panel latch system of claim 5, wherein the support structure comprises a wall or a ceiling.

7. The sliding panel latch system of claim 1, wherein the panel is a door.

8. The sliding panel latch system of claim 1, further comprising a latch body in support of the latch, wherein the latch is rotatably coupled to the latch body, and the latch body is coupled to the panel.

9. The sliding panel latch system of claim 1, wherein the striker includes a curved latch interface surface to engage the striker interface of the latch.

10. The sliding panel latch system of claim 9, wherein the striker interface comprises a curved surface to engage the curved latch interface surface.

11. The sliding panel latch system of claim 1, wherein the latch is biased to the receive/release position.

12. The sliding panel latch system of claim 1, further comprising a latch lock to maintain the latch in the latch position.

13. The sliding panel latch system of claim 12, wherein the latch lock is movable to a latch lock position, such that the latch is maintained in the latch position, and to a latch release position such that the latch is free to move between the latch and receive/release positions.

14. The sliding panel latch system of claim 13, wherein the latch lock is biased to the latch lock position.

15. The sliding panel latch system of claim 13, wherein the latch lock is bi-directionally movable in a translational degree of freedom.

16. The sliding panel latch system of claim 13, further comprising a latch lock user interface to facilitate movement of the latch lock from the latch lock position to the latch release position by a user.

17. The sliding panel latch system of claim 16, wherein the latch lock user interface is recessed within the panel.

18. The sliding panel latch system of claim 13, further comprising a panel lock to prevent the latch lock from moving out of the latch lock position.

19. The sliding panel latch system of claim 18, wherein the panel lock is movable to a panel lock position such that the latch lock is prevented from moving out of the latch lock position, and to a panel unlock position such that the latch lock is free to move between the latch lock and latch release positions.

20. The sliding panel latch system of claim 19, wherein the latch lock comprises an extension portion to couple with the panel lock.

21. The sliding panel latch system of claim 19, wherein the panel lock comprises a lock protrusion that mechanically interferes with movement of the latch lock when in the panel lock position.

22. The sliding panel latch system of claim 21, wherein the latch lock comprises a slidable plate, and the lock protrusion of the panel lock is configured to interface with the plate to mechanically interfere with movement of the latch lock when in the panel lock position.

23. The sliding panel latch system of claim 19, wherein the panel lock is bi-directionally movable in a rotational degree of freedom to the panel lock position and the panel unlock position.

24. The sliding panel latch system of claim 19, further comprising a panel lock user interface to facilitate movement of the panel lock to the panel lock position and to the panel unlock position by a user.

25. The sliding panel latch system of claim 24, wherein the panel lock user interface is movable with a key.

* * * * *